US009841702B2

(12) United States Patent
Srinivasan et al.

(10) Patent No.: US 9,841,702 B2
(45) **Date of Patent: *Dec. 12, 2017**

(54) SURFACE MODIFIED MAGNETIC CARRIERS USING HYDROPHOBIZED TITANIA

(71) Applicant: LEXMARK INTERNATIONAL, INC., Lexington, KY (US)

(72) Inventors: Kasturi Rangan Srinivasan, Longmont, CO (US); Michael Anthony Blassingame, Milliken, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/367,637

(22) Filed: Dec. 2, 2016

(65) Prior Publication Data

US 2017/0082952 A1 Mar. 23, 2017

Related U.S. Application Data

(63) Continuation-in-part of application No. 14/580,852, filed on Dec. 23, 2014, now Pat. No. 9,535,353.

(51) Int. Cl.

| | |
|---|---|
| ***G03G 9/00*** | (2006.01) |
| ***G03G 15/08*** | (2006.01) |
| ***G03G 9/08*** | (2006.01) |
| ***G03G 9/107*** | (2006.01) |
| ***G03G 9/113*** | (2006.01) |

(52) U.S. Cl.

CPC ..... *G03G 15/0889* (2013.01); *G03G 9/0804* (2013.01); *G03G 9/0808* (2013.01); *G03G 9/0815* (2013.01); *G03G 9/0817* (2013.01); *G03G 9/1075* (2013.01); *G03G 9/1131* (2013.01); *G03G 9/1132* (2013.01); *G03G 9/1133* (2013.01); *G03G 9/1135* (2013.01); *G03G 9/1136* (2013.01)

(58) Field of Classification Search

CPC ... G03G 9/1132; G03G 9/1135; G03G 9/1136
USPC ..... 430/111.31, 111.32, 111.35
See application file for complete search history.

(56) References Cited

U.S. PATENT DOCUMENTS

| | | | | |
|---|---|---|---|---|
| 6,042,982 | A | 3/2000 | Hakata | |
| 9,217,939 | B2 * | 12/2015 | Srinivasan | G03G 9/09725 |
| 9,535,353 | B2 * | 1/2017 | Srinivasan | G03G 9/0817 |
| 2014/0335449 | A1 | 11/2014 | Uratani | |
| 2014/0356782 | A1 | 12/2014 | Sugahara | |

* cited by examiner

*Primary Examiner* — Mark A Chapman

(57) ABSTRACT

A method for providing a developer mix having tribocharge uniformity across varying temperature and humidity conditions is provided. Tribocharge uniformity is achieved in the developer mix by performing the step of treating the surface of the polymer coated magnetic carrier particles with hydrophobized titania surface additives before the polymer coated magnetic carrier particles are mixed with the toner particles. The surface treatment with the hydrophobized titania surface additives can be either a spherical, disk, or spindle shaped.

16 Claims, No Drawings

SURFACE MODIFIED MAGNETIC CARRIERS USING HYDROPHOBIZED TITANIA

CROSS REFERENCES TO RELATED APPLICATIONS

This patent application is a Continuation-in-Part to U.S. patent application Ser. No. 14/580,852, filed Dec. 23, 2014, entitled "Formulation for a Developer Mix Having Tribocharge Uniformity of a Developer Mix Across Different Temperature and Humidity Conditions", which is assigned to the assignee of the present application.

STATEMENT REGARDING FEDERALLY SPONSORED RESEARCH OR DEVELOPMENT

None

BACKGROUND

1. Field of the Invention

The present disclosure is directed at a method for improving charge uniformity of a developer mix across various temperature and humidity conditions by performing the step of modifying the surface of the magnetic carrier particle by treating the surface of the magnetic carrier particle with hydrophobized titania surface additive before the magnetic carrier particle is mixed with the toner resin particle to form the developer mix.

2. Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

There are several known types of CPT including suspension polymerization toner, emulsion aggregation toner, latex aggregation toner, toner made from a dispersion of preformed polymer in solvent and chemically milled toner. While emulsion aggregation toner requires a more complex process than other CPTs, the resulting toner has a relatively narrower size distribution. Emulsion aggregation toners can also be manufactured with a smaller particle size allowing improved print resolution. The emulsion aggregation process also permits better control of the shape and structure of the toner particles which then allows the toner particles to be tailored to fit the desired cleaning, doctoring and transfer properties. The shape of the toner particles produced from an emulsion aggregation process may be optimized to ensure proper and efficient cleaning of the toner from various electrophotographic printer components, such as the developer roller, charge roller and doctoring blades, in order to prevent filming or unwanted deposition of toner on these components.

Toner may be utilized in image forming devices, such as printers, copiers and fax machines, to form images on a sheet of media. The image forming apparatus transfers the toner from a reservoir to the media via a developer system utilizing differential charges generated between the toner particles and the various components in the developer system. Electrophotographic printing can be carried out using a monocomponent development (MCD) system that requires the use of a toner adder roll, developer roll, and doctor blade for charging and doctoring the toner. Alternatively, the electrophotographic printing can be carried out using a dual component development (DCD) system which requires the use of a magnetic carrier particle and a magnetic roll to help charge the toner. Using a DCD system has the advantage of using fewer components and allowing for longer life cartridges and hence, a lower cost per page. Regardless of whether the toner is charged using a MCD or a DCD process, the printing of toner uses the same process of toner transfer to an imaging substrate that has been discharged via light, such as a photoconductor or photoreceptor drum or belt. Toner is then directly transferred to a media sheet or to an intermediate image transfer member before being transferred onto a media sheet.

In DCD printing, a mixture of toner particles and magnetic carrier particles is referred to as a developer mix. Mixing magnetic carrier particles with the surface-treated toner particles in the presence of some electrical voltage generates a triboelectric charge. It is preferred that the toner be separated from the magnetic carrier efficiently during a printing process, so as to have the required amount of toner mass on a magnetic roller. Insufficient separation of toner from a magnetic carrier can result in a lower amount of mass on the magnetic roller, and resulting in less toner developed or a light print. The uniform tribolelectric charging behavior of the developer mix supplies a uniform amount of toner to magnetic roller and subsequently to the photoconductor drum. Therefore, the print quality thus obtained is similar across various environments and does not change as a function of temperature and/or humidity.

It may be understood that in most cases, toner used for development of images have a relatively acceptable tribocharge and can be separated efficiently from a magnetic carrier. However, inventors have found that in some cases the emulsion aggregation method to make toner can result in a higher toner tribocharge, which may result in a difficulty to separate toner from a magnetic carrier. Using toner particles in a developer mix manufactured via an emulsion aggregation usually results in the developer mix having an undesirable variable charge across different temperature and humidity conditions. This is due to the fact that the emulsion aggregation process of making toner is a wet process that involves the use of flocculants such as metal salts, acids, and bases. The emulsion aggregation process also uses surfactants and/or dispersants in resin, pigment and wax emulsions. Insufficient removal of these surfactants or dispersants can have a significant negative impact on the tribocharge of the developer mix because the presence of acid, base or salts can negatively influence the tribocharging nature. For example, the presence of a trivalent salt such as aluminum chloride or aluminum sulfate can significantly lower the triboelectric charging behavior, in particular if it is a negative charging system. Additionally, the presence of salts on toner surface can negatively influence the interaction of the toner with moisture, thereby rendering the system humidity-sensitive.

Accordingly, it is desirous to achieve uniform tribocharge behavior for a developer mix from various toner batches and reproducibility across various manufacturing toner lots as well as across different temperature and humidity conditions. This tribocharge uniformity ultimately leads to uniform print quality throughout the life of the cartridge and not dependent on the varying environmental temperature and conditions.

SUMMARY OF THE INVENTION

The present disclosure is directed at a method for improving charge uniformity of a developer mix across various temperature and humidity conditions by modifying the surface of the magnetic carrier particle by treating the surface of the magnetic carrier particle with a hydrophobized titania surface additive before the magnetic carrier particle is mixed with the toner resin particle to form the developer mix. The titania surface additive is hydrophobized by the use of silanes.#

DETAILED DESCRIPTION

The present disclosure is directed at a method for a developer mix having tribocharge uniformity across different temperature and humidity conditions. This developer mix having tribocharge uniformity includes a magnetic carrier particle having surface additives on its surface. Exemplary surface additives include hydrophobized titania that may be either spherical, disk or spindle like in shape. Crystal form of the titania could be anatase, rutile or a mixture thereof. Additionally the titania is hydrophobized using a silane.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure is directed at a method for improving charge uniformity of a developer mix across various temperature and humidity conditions by modifying the surface of the magnetic carrier particle by treating the surface of the magnetic carrier particle with a hydrophobized titania surface additive before the magnetic carrier particle is mixed with the toner resin particle to form the developer mix. The titania surface additive is hydrophobized by the use of silanes. The hydrophobized titania can either be spherical in shape, disk-like in shape or spindle or needle-like in shape. The primary particle size of the hydrophobized titania can range from 10 nm to 50 nm. One needle shaped titania has a primary particle size of 5 nm to 60 nm. The crystal form of the hydrophobized titania can either be anatase, rutile or anatase-rutile.

A developer mix used in DCD printers is typically composed of toner mixed with magnetic carrier particles. The magnetic carrier particle serves two principal functions, namely transporting the toner for development to the photoconductor and imparting a triboelectric charge to the toner. Modern day DCD printers and copiers employ single or multiple magnetic developer rolls or magnetic brushes. Magnetic brushes with stationary magnets and rotating sleeves use magnetic carrier particles made from soft magnetic material and those with rotating magnets and stationary sleeves use hard magnetic materials. Magnetic carrier particles are typically in the range of 20 to 300 μm in size with smaller sizes typically between 30 to 50 μm generally preferred for better print or quality. The small magnetic carrier particle is typically spherical in nature; however, non-spherical carriers have been used. The magnetic material, typically called a carrier core, can be coated with a polymer based composition. The coating serves two principal functions, namely providing the triboelectric couple for charging the toner and preventing the toner from adhering to the carrier which limits the charging of the toner.

Soft magnetic materials used for the carrier core are usually derived from magnetic oxides either in the form of a magnetite or a ferrite. Ferrites for magnetic carriers are mixtures of iron oxide with oxides of zinc, copper, magnesium, or manganese that are combined through a combination of wet and dry processes to form the carrier core with the desired physical, chemical and magnetic properties.

Hard ferrite magnetic carriers tend to be permanent magnets. They exhibit high coercivity and remanence following magnetization. The high coercivity means the materials are very resistant to becoming demagnetized, an essential characteristic for a permanent magnet. They also tend to exhibit better magnetic flux and have high magnetic permeability. In contrast, Soft ferrite carriers have low coercivity and the magnetization can be reversed without dissipating much energy.

The carrier core can be coated using various known processes including powder coating, spray solution coating and fluidized bed processes. The coating material can be a dry polymer in the case of powder coating or a solution or suspension with a water or solvent base. Many types of polymers and polymer blends can be used in the carrier coatings including polystyrene, acrylics, acrylics modified with fluoropolymers, and siloxanes as examples. Various useful commercially available magnetic carrier particles are manufactured by Powdertech, Co. Ltd., Kashiwa City Japan, Dowa Electronics Materials Co. Ltd., Tokyo, Japan, and Issei Co. Ltd., Tokyo, Japan.

In the current invention, the inventor will show the ability to modify the toner tribocharge by suitably modifying the magnetic carrier surface by the addition of titania, which may vary in shape from a spherical to a disk shape, spindle or needle-like. Further the size of these titania can also be suitably varied, as shown in the following table. The list is for illustrative purposes only and is not meant to be exhaustive.

TABLE 1

Example Titania Surface Additives

| Surface Additive | Primary Particle Size (nm) | Crystal form/Shape | Surface Treatment on Surface Additive | Example/Supplier |
|---|---|---|---|---|
| Titania T1 | 40 nm | Anatase/Spherical | Silane | SGTO30C/Sukgyung AT |
| Titania T2 | 40 nm | Anatase/Disk | Silane | ST-530/Titan Kogyo, Ltd |
| Titania T3 | 40 nm | Anatase-Rutile/Disk | Silane | ST-550R, Titan Kogyo, Ltd |
| Titania T4 | 15 nm | Anatase/Spherical | Silane | JMT-150IB/Tayca Ltd |
| Titania T5 | 5 nm × 60 nm | Rutile/Spindle | Silane | ST-590C/Tayca Ltd |
| Titania T6 | 130 nm × 1.68 μm | Rutile/Acicular | Aluminum oxide | FTL-110/Ishihara Sangyo Kaisha, Ltd. |

In the present emulsion aggregation process, the toner particles are provided by chemical methods as opposed to physical methods such as pulverization. Generally, the toner includes one or more polymer binders, a release agent, a colorant, a borax coupling agent and one or more optional additives such as a charge control agent (CCA). An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used. The ratio of the amount of polymer binder in the toner core to the amount of toner in the shell is between about 20:80 (wt.) and about 80:20 (wt.) including all values and increments therebetween, such as between about 50:50 (wt.) and about 80:20 (wt.), depending on the particular resin(s) used.

The colorant, release agent, and the optional CCA are dispersed separately in their own aqueous environments or in one aqueous mixture, as desired, in the presence of a stabilizing agent having similar functionality (and ionic charge) as the stabilizing agent employed in the polymer latex. The polymer latex forming the toner core, the release agent dispersion, the colorant dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. Flocculation refers to the process by which destabilized particles conglomerate (due to e.g., the presence of available counterions) into relatively larger aggregates. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments.

The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Polymer Binder

As mentioned above, the toners herein include one or more polymer binders. The terms resin and polymer are used interchangeably herein as there is no technical difference between the two. The polymer binders can be either a polyester resin based, styrene-acrylate resin based, or mixtures thereof. In one embodiment, the polymer binder(s) include polyesters. The polyester binder(s) may include a semi-crystalline polyester binder, a crystalline polyester binder or an amorphous polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. In other embodiments, the polymer binder(s) include a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates).

As discussed above, in some embodiments, the toner core may be formed from one polymer binder (or mixture) and the toner shell formed from another. Further, the ratio of the amount of polymer binder in the toner core to the amount of toner in the toner shell may be between about 20:80 (wt.) and about 80:20 (wt.) or more specifically between about 50:50 (wt.) and about 80:20 (wt.) including all values and increments therebetween. The total polymer binder may be provided in the range of about 70% to about 95% by weight of the final toner formulation including all values and increments therebetween.

Toner prepared using a polyester resin or styrene-acrylate, etc., may also comprise of a colorant, a release agent, a coupling agent such as Borax (also known as sodium borate, sodium tetraborate, or disodium tetraborate), a charge control agent, etc. Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. The release agent may include any compound that facilitates the release of toner from a component in an electrophotographic printer (e.g., release from a roller surface). For example, the release agent may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters. The release agent may therefore include a low molecular weight hydrocarbon based polymer (e.g., Mn≤10,000) having a melting point of less than about 140° C. including all values and increments between about 50° C. and about 140° C. A surfactant, a polymeric dispersant or a combination thereof may be used. The polymeric dispersant may generally include three components, namely, a hydrophilic component, a hydrophobic component and a protective colloid component. The dispersant employed herein may include the dispersants disclosed in U.S. Pat. Nos. 6,991,884 and 5,714,538, which are incorporated by reference herein in their entirety. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

Optionally, extra particular additives such as various sized silicas may also be added to the surface of the toner particle to improve its' flow. The toner may be treated with a small sized silica having an average primary particle size in the range of 2 nm to 20 nm, or between 5 nm to 15 nm (largest cross-sectional linear dimension) prior to any after treatment, including all values and increments therein. Medium silica may be understood as silica having a primary particle size in the range of 30 nm to 60 nm, or between 40 nm to 50 nm, prior to any after treatment, including all values and increments therein. The medium silica may be present in the toner formulation as an extra particulate agent in the range of 0.1% to 3.0% by weight of the toner composition, including all values and increments in the range of 0.1% to 3.0% by weight. Large sized silica may be used in addition to a small and medium sized silica. Large sized silica which may be understood to be of a primary particle size from about 60 nm to about 120 nm, may be obtained via a fuming or a sol-gel process. The large silica may be present in the toner formulation as an extra particulate agent in the range of 0.1 wt % to 3.0 wt %, for example in the range of 0.25 wt % to 2.0 wt % of the toner composition.

The following examples are provided to further illustrate the teachings of the present disclosure, not to limit the scope of the present disclosure.

EXAMPLES

Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of polyethylene wax from Petrolite, Corp., Westlake, Ohio, USA was slowly added while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight.

Example Polyester Resin Emulsion

A polyester resin having a glass transition temperature (Tg) of about 53° C. to about 58° C., a melt temperature (Tm) of about 110° C., and an acid value of about 15 to about 20 was used. The glass transition temperature is measured by differential scanning calorimetry (DSC), wherein, in this case, the onset of the shift in baseline (heat capacity) thereby indicates that the Tg may occur at about 53° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 10 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

Example Toner A

The Example Polyester Resin Emulsion A (or, different polyester resin emulsions may be used in the core layer and shell layer) was divided into two batches, split 70:30 by weight to form the core and the shell of the toner, respectively. The total polyester content represented about 87.7% of the total toner solids. Accordingly, the first batch contained 61.4% of the total toner solids and the second batch contained 26.3% of the total toner solids. Components were added to a 2.5 liter reactor in the following percentages: the first batch of the Example Polyester Resin Emulsion A having 61.4 parts (polyester by weight), 6.8 parts (pigment by weight) of the Example Cyan Pigment Dispersion, and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 200 g of 1% sulfuric acid solution. The flow of the loop was then reversed to return the toner mixture to the reactor and the temperature of the reactor was increased to about 40-45° C. Once the particle size reached 4.0 μm (number average), 5% (wt.) borax solution (30 g of solution having 1.5 g of borax) was added. The borax content represented about 0.5% by weight of the total toner solids. After the addition of borax, the second batch of the Example Polyester Resin Emulsion A was added, which contained 26.3 parts (polyester by weight). The mixture was stirred for about 5 minutes and the pH was monitored. Once the particle size reached 5.5 μm (number average), 4% NaOH was added to raise the pH to about 5.95 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.65 μm and a number average particle size of 5.49 μm. Fines (<2 μm) were present at 0.11% (by number) and the toner possessed a circularity of 0.978.

Toner A was placed in a CYCLOMIX along with about 0.5% by weight of small silica such as Aerosil R812 from Evonik Corporation, 1.0% of medium silica RY50 from Evonik Corporation and 2.0% of large silica such as SGSO100CDM8 from Sukgyung AT Inc. The CYCLOMIX was run for about 90 seconds. Subsequently the finished toner was evaluated.

Example Magnetic Carrier Particle

Illustrative examples of magnetic carrier particles that can be selected for mixing with the toner prepared as outlined above include those carriers that are capable of triboelectrically obtaining a charge of opposite polarity to that of the toner particles. Examples of such carrier particles include iron, iron alloys, steel, nickel, iron ferrites, including iron ferrites that incorporate magnesium, manganese, magnetites, strontium, copper, zinc and the like. The selected carrier particles can be used with or without a coating. The coating is generally made from acrylic and methacrylic polymers such as methyl methacrylate, acrylic and methacrylic copolymers with fluoropolymers or with monoalkyl or dialkylamines, polyolefins, polystyrenes, such as polyvinylidene fluoride resins, terpolymers of styrene, methyl methacrylate, and a silane such as triethoxy silane, tetraflouroethylenes and other known coatings in the art. Useful magnetic carriers to be used in the present invention have a average volume particle size between 25 μm and 40 μm, a saturation magnetization between 50 and 120 emu/g ($A \cdot m^2/kg$), apparent bulk density between 2.0-2.7 $g/cm^3$, and true specific gravity between 4.5-5.3. Unless otherwise stated, all developer mixes discussed are formulated and tested herein comprise a mixture of Toner A described above mixed with a magnetic carrier particle using a ferrite carrier with an acrylic coating having an average size particle between 35 μm and 40 μm and a saturation magnetization between 65 and 72 emu/g ($A \cdot m^2/kg$). This particular magnetic carrier particle is hereinafter referred to as 'Control Magnetic Carrier'.

Preparation of Comparative Developer Mix 1

0.8 grams of Toner A was mixed with 9.2 grams of Control Magnetic Carrier (toner concentration 8% by weight and control magnetic carrier concentration 92% by weight) in a Turbula mixer for about 10 minutes at 56 rpm to form Comparative Developer Mix 1. Initial tribocharge of Comparative Developer Mix 1 was measured in a q/m Epping meter based on a known toner mass. The Epping toner charge value reported for all toners tested herein may be determined by combining the toner and magnetic carrier beads which tribocharge each other. Accordingly, a known amount of toner and carrier beads may be mixed and shaken together, and a pre-weighed sample of such toner/bead combination placed in a Faraday cage with screens on both ends. The Epping meter consists of this cage and directs air in one end of the cage. Charged toner passes with the air stream out of the other end of the cage (i.e., the screen retains the carrier beads). Weights before and after toner removal may provide toner mass; an electrometer may measure the toner charge (i.e., carrier charge of equal and opposite sign corresponding to the toner removed). It should therefore be appreciated that toner charge may serve as a basis for evaluating toner conveyance in an electrophotographic system.

Preparation of Developer Mix 1a 400 grams of Control Magnetic Carrier and 0.20 grams of titania T1, identified in table 1, were weighed in a glass jar, and mixed in a Turbula mixer for about 5 minutes at about 56 rpm to form Magnetic Carrier 1a. Magnetic Carrier 1a was sieved through a 75 μm screen. Following this pretreatment step, 0.8 grams of Toner A was mixed with 9.2 grams of Magnetic Carrier 1a (toner concentration 8% by weight and magnetic carrier 1a concentration 92% by weight) in a Turbula mixer for about 10 minutes at 56 rpm to form Developer Mix 1a. Initial tribocharge of the Developer Mix 1a was measured in a q/m Epping meter based on a known toner mass.

Preparation of Developer Mix 1b

Developer Mix 1b was prepared in a manner similar to Developer Mix 1a, with the exception that 0.20 grams of titania T2 was used to form Magnetic Carrier 1b.

Preparation of Developer Mix 1c

Developer Mix 1c was prepared in a manner similar to Developer Mix 1a, with the exception that 0.20 grams of titania T3 was used to form Magnetic Carrier 1c.

Preparation of Developer Mix 1d

Developer Mix 1d was prepared in a manner similar to Developer Mix 1a, with the exception that 0.20 grams of titania T4 was used to form Magnetic Carrier 1d.

Preparation of Developer Mix 1e

Developer Mix 1e was prepared in a manner similar to Developer Mix 1a, with the exception that 0.20 grams of titania T5 was used to form Magnetic Carrier 1e.

Preparation of Developer Mix 1f

Developer Mix 1f was prepared in a manner similar to Developer Mix 1a, with the exception that 0.40 grams of titania T5 was used to form Magnetic Carrier 1f.

Table 2 summarizes the tribocharge of Toner A as measured using an epping instrument and the charge distribution measured using a qd charge spectrometer such as a q test instrument, manufactured by PES Laboratorium. One key metric when making a developer mix is the uniformity of the developer mix. The uniformity of the developer mix is determined by incorporation of toner on to carrier surface, and no free toner, which would be reflected as multiple charge peaks in a charge distribution. The charge distribution curve as observed for Comparative 1 Developer Mix indicates a bi-modal distribution in contrast to the monomodal distribution observed for Developer Mixes 1a to 1f. This monomodal distribution indicates that either the carrier is not uniformly coated with Toner A or there is a sufficient amount of Toner A that is not on the surface of the magnetic carrier. The Toner Concentration (% Tc) reported in Table 2 for Comparative 1 Developer Mix having an untreated magnetic carrier is an undesirable 3.46% Tc following an epping blow-off measurement. Moreover, the high tribocharge of Comparative 1 Developer Mix (−76.8 μC/g) may be the result of Toner A adhering to the magnetic carrier or the poor mixing of Toner A with the magnetic carrier. This is not a desirable result. However, when the same magnetic carrier is surface treated with titania additives T1, T2, T3, T4, and T5, Developer Mixes 1a, 1b, 1c, 1d, 1e and 1f show a more efficient removal of toner from the magnetic carrier surface as measured by an epping blow off measurement—% Tc between 7.64% and 8.17%. The higher % Tc readings are desirable for a developer mix because in a printing process the toner is developed on to an imaging substrate by a similar process, and if it is difficult to separate the toner from the magnetic carrier surface, the resulting image on a substrate would be relatively light due to insufficient toner. However, if the separation of toner from the magnetic carrier is efficient, the toner mass on a magnetic roller can be adjusted in a way to get the required mass of toner on an imaging substrate, thereby achieving the required print density on the substrate.

Furthermore, Table 2 also shows the possibility of tailoring the tribocharge of a toner by surface treating the outer surface of the magnetic carrier with particular titania surface additives, for example as listed in Table 1. Toner A used in the various developer mixes listed in Table 2 was not changed. The tribocharge of Toner A varies from about −60 μC/g to about −11 μC/g. The tribocharge was able to be manipulated by simply varying the type of titania surface additive on the surface of the magnetic carrier. Titania T1 and titania T2 have similar properties including primary particle size of about 40 nm, anatase crystal form, and are

TABLE 2

Effect of Pre-Treating Carrier with Titania on Tribocharge of Toner A

| Developer Mix | Titania Surface Additive on Magnetic Carrier | Charge distribution | Initial Tribocharge (μC/g) | Toner Concentration (% Tc) | Tribocharge after mixing for 30 min. @ 96 rpm (μC/g) | Toner Concentration after mixing for 30 min. @ 96 rpm (% Tc) |
|---|---|---|---|---|---|---|
| Comparative 1 | None | Bimodal | −76.8 | 3.46% | −68.1 | 5.86% |
| 1a | 0.05% T1 | Monomodal | −60.1 | 7.64% | −49.6 | 7.85% |
| 1b | 0.05% T2 | Monomodal | −27.4 | 8.07% | −34.9 | 8.01% |
| 1c | 0.05% T3 | Monomodal | −17.1 | 8.10% | −27.9 | 8.00% |
| 1d | 0.05% T4 | Monomodal | −11.9 | 8.04% | −23.4 | 8.05% |
| 1e | 0.05% T5 | Monomodal | −44.1 | 8.00% | −25.3 | 7.80% |
| 1f | 0.10% T5 | Monomodal | −26.1 | 8.17% | −12.3 | 7.85% |

hydrophobized using a silane, but vary in their shape. Titania T1 is spherical while titania T2 is a disk shaped. Developer Mix 1a using spherical titania T1 as a surface additive to the magnetic carrier exhibits a charge of about −60 μC/g in comparison to a tribocharge of about −27 μC/g for Developer Mix 1b using disk shaped titania T2 as a surface additive to the magnetic carrier. Another comparison for the different types of titania is the initial charge distribution of Developer Mix 1b versus the initial charge distribution of Developer Mix 1c. Titania T3 is based on an anatase and rutile crystal form. Whereas the use of disk shaped titania T2 as a surface additive to the magnetic carrier imparts a tribocharge of about −27 μC/g for the Developer Mix 1b, the use of titania T3 having an anatase and rutile crystal form lowers the charge of Developer Mix 1c to about −17 μC/g. Titania T2 and T3 titania have a similar size of 40 nm and similar silane surface treatment but differ in their crystal form and interestingly impart a different tribocharge to their respective developer mixes. On the other hand, titania T5 is based on a rutile form and its primary particle size for the spindle shaped structure is 5 nm×60 nm. As a surface additive on the magnetic carrier surface, titania tends to exhibit a different behavior on the tribocharge without compromising the efficiency to remove the toner from the carrier surface as evidenced by the resulting % Tc reading in Table 2. By increasing the amount of titania T5 on the magnetic carrier surface to 0.10% as used in Developer Mix 1f, the resulting toner tribocharge of −26.1 μC/g tends to approach the tribocharge of the developer mixes using of the anatase form of titania. It can also be appreciated that the tendency for charge to be modulated to be more negative or less negative can be altered by using the crystal form of the titania and/or by adjusting the amount of the titania surface additive. Titania T4 has smaller primary particle size of 15 nm with an anatase crystal form and can also be used to lower the tribocharge of the toner.

The developer mix in a developer cartridge is subjected to constant mixing and churn, which may inherently change the performance of the developer mix. It is preferred that the developer mix is still capable of exhibiting efficient separation of the toner from the carrier surface. In examining the test results from Table 2, Comparative Developer Mix 1 having no surface treatment on its magnetic carrier particle still exhibits a high toner charge and is unable to achieve the required separation of toner—thus resulting in a lower % Tc of about 5.86%. Although the separation of the toner from the magnetic carrier in Comparative Developer Mix 1 is better following the exposure to a hot/humid environment (See Table 3), it is still inferior compared to the % Tc reported for the developer mixes shown in Table 2. An interesting finding is the variation in charge change as a function of titania type. Whereas the toner tribocharge changes from about −17 μC/g to about −28 μC/g after churning Developer Mix 1c, Developer Mix 1a shows the charge change in the opposite direction from about −60 μC/g to about −49.6 μC/g after churning. Additionally Developer Mix 1e shows the same charge change in the opposite direction. Hence, depending on the toner and printer developer cartridge, the tribocharge of the toner through cartridge life can be modified by suitably selecting a surface additive, as shown in Table 2. For example, if a system requires darker prints, charge change can be adjusted to be approaching more neutral, as shown in Examples 1e and 1f, or if a system has a tendency to create more wrong sign toner, an example such as 1b or 1c, can mitigate by exhibiting higher charge on churning the system.

TABLE 3

Charge stability across environments

| Developer Mix | Surface Additive on Magnetic Carrier | Epping QT (at Lab Ambient, 60 hrs), μC/g | % Tc (at LabAmbient) | Epping QT (at 78 F./80% RH, 60 hrs), μC/g | % Tc (at 78 F./80% RH) |
|---|---|---|---|---|---|
| Comparative 1 | None | −76.8 | 3.46% | −74.3 | 4.28% |
| 1a | 0.05% T1 | −60.1 | 7.64% | −66.3 | 6.56% |
| 1c | 0.05% T3 | −17.1 | 8.10% | −16.9 | 8.14% |
| 1d | 0.05% T5 | −44.1 | 8.00% | −39.8 | 8.03% |
| 1e | 0.1% T5 | −26.1 | 8.17% | −23.8 | 8.08% |

Earlier, the capability of suitably moderating toner tribocharge by manipulating the particular type of titania surface additive on the magnetic carrier was described. Further to the ability of modifying the toner tribocharge, the possibility of achieving uniform tribocharge across lab ambient environment to a hot/wet environment is also seen by the use of magnetic carrier that is surface treated with a titania surface additive. Comparative Developer Mix 1 shows a charge that is relatively stable, however, the charge is based on about 4.28% Tc of the toner that was removed or developed. In comparison, Developer Mixes listed in Table 3 having magnetic carriers that are surface treated with a titania show efficient removal of toner and also a tribocharge that does not change significantly.

Preparation of Developer Mix 2a 500 grams of Control Magnetic Carrier and 0.5 gram of titania T6, were weighed and added to a glass jar, and mixed for about 5 minutes. The control magnetic carrier mixed with the titania T6 was screened through a 75 μm screen to produce Magnetic Carrier 2a. Following this pretreatment step, 0.8 grams of Toner A was mixed with 9.2 grams of Magnetic Carrier 2a (toner concentration 8% by weight and magnetic carrier 2a concentration 92% by weight) in a Turbula mixer for about 10 minutes at 56 rpm to produce Developer Mix 2a. Initial tribocharge of Developer Mix 2a was measured in a q/m Epping meter based on a known toner mass.

Preparation of Developer Mix 2b 500 grams of Control Magnetic Carrier and 1.25 gram of titania T6 were weighed and added to a glass jar, and mixed for about 5 minutes. The control magnetic carrier mixed with the titania T6 was screened through a 75 μm screen to produce Magnetic Carrier 2b. Following this pretreatment step, 0.8 grams of Toner A was mixed with 9.2 grams of Magnetic Carrier 2b (toner concentration 8% by weight and magnetic carrier 2b concentration 92% by weight) in a Turbula mixer for about 10 minutes at 56 rpm to form Developer Mix 2b. Initial tribocharge of Developer Mix 2b was measured in a q/m Epping meter based on a known toner mass.

TABLE 4

Epping Charge for Developer Mixes Using an Acicular Titania as a Surface Additive on the Magnetic Carrier

| Developer Mix | Surface Additive on Magnetic Carrier | Initial Tribocharge (μC/g) | Toner Concentration (% Tc) |
|---|---|---|---|
| Comparative 2 | None | −76.4 | 3.59% |
| Example 2a | 0.1% Titania T6 | −79.5 | 5.82% |
| Example 2b | 0.25% Titania T6 | −78.6 | 5.35% |

Table 4 explores the feasibility of a using a larger acicular titania sized 130 nm×1.68 μm, such as titania T6 described in Table 1. In contrast to titania T5 which is a spindle shape having a size of about 5 nm×60 nm, Titania T6 is significantly larger, measuring 130 nm×1.68 μm. However, irrespective of the amount of titania T6 on the magnetic carrier surface (0.1% and 0.25%), the resulting Epping charge measurement reported in Table 4 shows a poor separation of toner from the magnetic carrier surface. Developer Mixes 2a and 2b both had a comparable % Tc result of 5.82% and 5.35%, respectively. These % Tc results are better than the % Tc result reported for the Comparative Developer Mix having an untreated magnetic carrier. However the % Tc results for Developer Mixes 2a and 2b are significantly lower than the 7.64% Tc to 8.17% Tc reported for Developer Mixes 1a-1f in Table 2. The titania used as a surface additive to the magnetic carrier in Table 2 exhibited an efficient separation.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for forming a developer mix to be used in an electrophotographic imaging device comprising:

providing toner particles formed an emulsion aggregation process;

providing magnetic carrier particles having a polymer coating on its outer surface;

surface treating the outer surface of the polymer coated magnetic carrier particles with hydrophobized titania extra particular additives: and mixing the toner particles and the hydrophobized titania surface treated polymer coated magnetic carrier particles.

2. The method of claim 1 further comprising the steps of screening the hydrophobized titania surface treated polymer coated magnetic carrier particles to remove the hydrophobized titania extra particular additives having large agglomerates prior to the mixing of the hydrophobized titania surface treated polymer coated magnetic carrier particles and the toner particles.

3. The method of claim 1, wherein the polymer coating is acrylic.

4. The method of claim 1 wherein the polymer coated magnetic carrier particles have a ferrite core.

5. The method of claim 1, wherein the hydrophobized titania extra particular additives have a spherical shape.

6. The method of claim 5, wherein the spherical hydrophobized titania extra particular additives have a primary particle size of 40 nm and an anatase crystal form.

7. The method of claim 5, wherein the spherical shaped hydrophobized titania extra particular additives have a primary particle size of 15 nm and an anatase crystal form.

8. The method of claim 1, wherein the hydrophobized titania extra particular additives have a disk shape.

9. The method of claim 8, wherein the disk shaped hydrophobized titania extra particular additives have a primary particle size of 40 nm and an anatase crystal form.

10. The method of claim 8, wherein the disk shaped hydrophobized titania extra particular additives have a primary particle size of 40 nm and an anatase-rutile crystal form.

11. The method of claim 1, wherein the hydrophobized titania extra particular additives have a spindle shape.

12. The method of claim 11, wherein the spindle shaped hydrophobized titania extra particular additives have a primary particle size of 5 nm×60 nm and a rutile crystal form.

13. The method of claim 1, wherein the hydrophobized titania extra particular additives have an acicular shape.

14. The method of claim 13, wherein the acicular shaped hydrophobized titania extra particular additives have a primary particle size of 130 nm×1.68 μm and a rutile crystal form.

15. The method of claim 1, wherein the hydrophobizing agent is a silane.

16. A method for forming a developer mix to be used in an electrophotographic imaging device comprising:

providing toner particles formed using an emulsion aggregation process;

providing magnetic carrier particles having a polymer coating on their outer surface;

surface treating the outer surface of the polymer coated magnetic carrier particle with hydrophobized titania extra particular additives;

screening the hydrophobized titania surface treated polymer coated magnetic carrier particles to remove large agglomerates of the hydrophobized titania extra particular additives: and mixing the toner particles with the screened hydrophobized titania surface treated polymer coated magnetic carrier particles.

* * * * *